US008011701B2

(12) United States Patent
Taylor

(10) Patent No.: US 8,011,701 B2
(45) Date of Patent: Sep. 6, 2011

(54) RECEPTACLE SECURING DEVICE

(75) Inventor: Curtis Taylor, Chagrin Falls, OH (US)

(73) Assignee: Process4, Chagrin Falls, OH (US)

( * ) Notice: Subject to any disclaimer, the term of this patent is extended or adjusted under 35 U.S.C. 154(b) by 744 days.

(21) Appl. No.: 11/803,487

(22) Filed: May 15, 2007

(65) Prior Publication Data

US 2008/0284181 A1 Nov. 20, 2008

(51) Int. Cl.
*B65D 45/00* (2006.01)

(52) U.S. Cl. ..... 292/256; 248/154; 248/346.07

(58) Field of Classification Search ..... 292/256, 292/256.5, 256.63; 248/154, 146, 149, 150, 248/151, 346.03, 346.07, 346.5
See application file for complete search history.

(56) References Cited

U.S. PATENT DOCUMENTS

| | | | | |
|---|---|---|---|---|
| 2,030,775 | A * | 2/1936 | Twiss | 248/149 |
| 2,851,185 | A * | 9/1958 | Taylor | 248/346.04 |
| 2,853,261 | A * | 9/1958 | Loeb | 248/151 |
| 3,208,314 | A * | 9/1965 | Locke | 81/436 |
| 5,143,338 | A * | 9/1992 | Eberlin | 248/313 |
| 5,232,188 | A * | 8/1993 | Troncone | 248/154 |
| 6,040,514 | A * | 3/2000 | Liao | 84/421 |
| 6,361,001 | B1 * | 3/2002 | Durand | 248/146 |
| 6,464,184 | B1 * | 10/2002 | Lytle | 248/126 |
| 6,464,187 | B1 * | 10/2002 | Bieck et al. | 248/311.2 |
| 6,533,227 | B1 | 3/2003 | Rom | |
| 6,749,167 | B2 * | 6/2004 | Kaupp et al. | 248/311.2 |
| 7,018,090 | B2 | 3/2006 | Moore | |
| 7,178,766 | B2 * | 2/2007 | Forshee et al. | 248/146 |
| 7,258,312 | B2 * | 8/2007 | Grosse | 248/154 |
| 7,261,262 | B2 * | 8/2007 | Dunson | 248/154 |
| 7,651,060 | B2 * | 1/2010 | Roth et al. | 248/146 |
| 7,708,242 | B1 * | 5/2010 | Petrashune et al. | 248/150 |
| 2003/0016586 | A1 * | 1/2003 | Williams | 366/349 |
| 2006/0202093 | A1 | 9/2006 | Grosse | |
| 2007/0076519 | A1 * | 4/2007 | Kesling | 366/129 |

* cited by examiner

*Primary Examiner* — Kristina Fulton
(74) *Attorney, Agent, or Firm* — Fay Sharpe LLP; Brian E. Turung

(57) ABSTRACT

A receptacle securing device designed to at least partially secure a receptacle in a generally static position during manipulation of contents in the receptacle. The receptacle securing device includes a base member that is designed to receive a bottom of a receptacle, at least one pressure pad that is designed to receive user generated pressure, and a plurality of arm members that are connected to the base member. At least one of the arm members is designed to pivot toward and grippingly engage the receptacle when the receptacle is positioned on the receptacle securing device. The receptacle securing device can be designed to be foldable upon itself to facilitate its shipping and transport by minimizing its size profile.

24 Claims, 9 Drawing Sheets

RECEPTACLE SECURING DEVICE

The present invention relates to a device that can be used to maintain a receptacle in position, and more particularly to a device that is designed to be permanently or releasably secured to a receptacle so as to inhibit or prevent the receptacle from moving and/or at least partially rotating and/or lifting during use of the receptacle.

BACKGROUND OF THE INVENTION

Many products are sold in liquid form such as, but not limited to, paints, primers, roof coatings, mastics, dry wall joint compounds, roofing cement, floor or wood sealants, etc. These products are typically packaged and marketed in receptacles such as, but not limited to, buckets (e.g., one gallon cans, five gallon buckets, etc.). Prior to the use of the product contained in the receptacle, the product should typically be manipulated (e.g., stirred, shaken, etc.). Generally the product is stirred in the receptacle by hand (e.g., hand stirring by a mixing or stirring stick, etc.) or by some type of mechanical or electrical device (e.g., motorized stirrer, etc.). Regardless of the stirring technique used, stirring of the product in the receptacle generally produces a rotational force that is transmitted to the receptacle, which rotational force tends to cause the receptacle to rotate, wobble, lift-up, or otherwise move during the stirring process. The movement of the receptacle during a stirring process can complicate the process of stirring and/or cause spillage from the receptacle during the stirring process, thus can require the stirring user to adopt an awkward position relative to the receptacle to secure the receptacle in position during the stirring process. For example, users typically have to straddle the receptacle between their legs so as to overcome the rotational and/or other movement tendencies of the receptacle during a stirring process. The need for the user to have to maintain the receptacle in position while stirring and/or mixing a product in the receptacle can be difficult, uncomfortable and/or tedious to the user and/or can result in an inefficient stirring or mixing process. Additionally, the complications of receptacle movement during the stirring or mixing process can have other undesired consequences such as, but not limited to, spillage of the product from the receptacle, injury to the user, and/or loss of efficiency and time during the mixing or stirring process.

A variety of devices have been proposed for supporting, stabilizing, gripping and/or holding buckets to prevent their upsetting, rotating or otherwise moving during the stirring or mixing of bucket contents. Some of these devices are cumbersome, heavy and/or awkward to carry, and thus have not been suitably portable. Many of these prior devices have proven to be ill suited to securely grip the exterior surfaces of the type of buckets that contain viscous materials (e.g., adhesives, mastics, coatings and other viscous materials). Commonly these types of materials are sold in plastic buckets, typically of about a five gallon capacity, that have smooth, often slick, exterior surfaces that are difficult to hold in a frictional grip.

Stand-on bucket holders of various types have been proposed. These prior art stand-on bucket holders have a) failed to provide satisfactorily gripping of the smooth, often slick, exterior surfaces of plastic buckets; b) failed to effectively utilize the weight of an operator to prevent bucket movement during the mixing or stirring of the bucket contents; c) been unduly awkward or heavy to carry, to set-up, and/or to use; d) been too complicated or complex to manufacture inexpensively; and/or e) presented other drawbacks that have impeded market acceptance. Some prior art bucket holders have a design that can interfere with the stirring or mixing of the bucket contents by employing one or more rim gripping components that significantly overhang the top opening of the buckets in a manner that can obstruct access to the interior of the bucket.

In view of the current state of the prior art, there is a need for a simple, portable, easy-to-setup and easy-to-use device, that is relatively inexpensive to manufacture, which device can secure a receptacle in place in a convenient and reliable manner.

SUMMARY OF THE INVENTION

The present invention relates to a securing device that is used to maintain a receptacle in position during the stirring and/or mixing of the contents of the receptacle. The securing device is designed to be releasably secured to a receptacle so as to inhibit or prevent the receptacle from moving and/or at least partially rotating and/or lifting while the contents of the receptacle are stirred and/or mixed. The secure device is particularly designed to be used with larger receptacles (two gallon container or larger); however, it can be appreciated that the securing device of the present invention can be designed for sized and/or shaped receptacles. The securing device is generally designed to securely grip the receptacle at and/or below the top rim of the receptacle so as to not interfere with the stirring and/or mixing of the contents in the receptacle. The securing device is also generally designed to be able to adequately grip the outer surface of the receptacle, which in some cases is a smooth metal or plastic surface. These smooth surfaces can create a slick surface that can be difficult to properly grip. The securing device of the present invention is designed to adequately grip such surfaces of the receptacle during the stirring and/or mixing of the contents in the receptacle. In one non-limiting embodiment of the present invention, the securing device is designed such that the weight of a user on at least a portion of the securing device can be used to at least partially cause the securing device to engage and/or grip the receptacle. In another and/or alternative non-limiting embodiment of the present invention, the securing device is designed such that a user can easily and conveniently use the securing device to inhibit or prevent the rotation and/or other movements of the receptacle during the stirring and/or mixing of the receptacle contents. In still another and/or alternative non-limiting embodiment of the present invention, the securing device is designed such that the securing device is lightweight, easy to grasp, easy to carry, and/or has a compact configuration for storage and/or transport.

In one non-limiting aspect of the invention, the securing device in accordance with the present invention is directed to a receptacle securing device that is designed to at least partially maintain a receptacle in a static position during manipulation (e.g., mixing, stirring, etc.) of the contents of the receptacle. The securing device generally includes a base member that is designed to receive at least a bottom portion of the receptacle; at least one pressure pad that is designed to receive a user generated pressure to at least partially cause the securing device to secure to the receptacle; and a plurality of arm members designed to moveably engage the receptacle so as to engage with and disengage from the receptacle. In one non-limiting embodiment of the invention, the securing device is designed to cause at least one arm member to move into engagement with and/or move into tighter engagement with at least one portion of the receptacle when a user applies pressure to the at least one pressure pad. In another and/or alternative non-limiting embodiment of the invention, the securing device is designed to cause a plurality of arm members to move into engagement with and/or move into tighter engagement with at least one portion of the receptacle when a user applies pressure to the at least one pressure pad. In still another and/or alternative non-limiting embodiment of the invention, the securing device includes at least two arm members. In yet another and/or alternative non-limiting embodiment of the invention, the securing device includes two to five arm members. In still yet another and/or alternative non-limiting embodiment of the invention, the securing device includes at least two pressure pads.

In another and/or alternative non-limiting aspect of the invention, the securing device in accordance with the present invention includes a base member that is connected and/or interconnected to at least one arm member and at least one pressure pad. In one non-limiting embodiment of the invention, at least one arm member is pivotally connected or interconnected with the base member. In another and/or alternative non-limiting embodiment of the invention, a plurality of arm members are pivotally connected or interconnected with the base member. In still another and/or alternative non-limiting embodiment of the invention, a plurality of pressure pads are connected or interconnected with the base member. In yet another and/or alternative non-limiting embodiment of the invention, at least one pressure pad is connected or interconnected with the base member on a side opposite to a side of the base member where another pressure pad is connected or interconnected with the base member.

In still another and/or alternative non-limiting aspect of the invention, the securing device in accordance with the present invention includes a base member that includes first and second portions that are moveable with respect to one another. In one non-limiting embodiment of the invention, the first and second portions of the base member are pivotally connected together by a hinge, a flexible material, a spring, and/or the like. In one non-limiting specific arrangement, at least one arm member is connected to at least a portion of the base member by a living hinge. In another and/or alternative non-limiting specific arrangement, at least one arm member is connected to at least a portion of the base member by a living hinge made at least partially of steel, polypropylene, high density polyethylene, or the like. In another and/or alternative non-limiting embodiment of the invention, at least one pressure pad that is connected or interconnected to one or more portions of the base member causes at least one portion of the base member to pivotally move relative to at least one other portion of the base member when a user applies pressure to and/or releases pressure from one or more of the pressure pads. In still another and/or alternative non-limiting embodiment of the invention, when at least one portion of the base member pivotally moves relative to at least one other portion of the base member, at least one arm member moves toward and/or away from a portion of the receptacle when the receptacle is at least partially positioned on the securing device.

In yet another and/or alternative non-limiting aspect of the invention, the securing device in accordance with the present invention includes at least one pressure pad that includes a gripping surface that improves the grip between the hand or foot of a user that is applying pressure to the at least one pressure pad. In one non-limiting embodiment of the present invention, the gripping surface includes a rough rigid surface; however, it can be appreciated that other or additional types of gripping surfaces can be used. In another and/or alternative non-limiting embodiment of the present invention, the gripping surface is removeably connected to the pressure pad.

In still yet another and/or alternative non-limiting aspect of the invention, the securing device in accordance with the present invention includes at least one arm member that includes a gripping surface that improves the grip between the arm member and a portion of the receptacle. In one non-limiting embodiment of the present invention, the gripping surface includes a rough rigid surface; however, it can be appreciated that other or additional types of gripping surfaces can be used. In another and/or alternative non-limiting embodiment of the present invention, the gripping surface is removeably connected to the arm member.

In another and/or alternative non-limiting aspect of the invention, the securing device in accordance with the present invention at least one arm member is pivotally connected to at least a portion of the base member. In one non-limiting embodiment of the invention, at least one arm member is connected to at least a portion of the base member by a hinge, a flexible material, a spring, and/or the like. In one non-limiting specific arrangement, at least one arm member is connected to at least a portion of the base member by a living hinge. In another and/or alternative non-limiting specific arrangement, at least one arm member is connected to at least a portion of the base member by a living hinge made at least partially of steel, polypropylene, high density polyethylene, or the like. In another and/or alternative non-limiting embodiment of the invention, at least one arm member is pivotally connected to at least a portion of the base member at the or near the bottom of the arm member.

In still another and/or alternative non-limiting aspect of the invention, the securing device in accordance with the present invention, the base member includes at least two portions that can be at least partially folded together to reduce the size of the secure device and thereby facilitate in the transport and/or storage of the securing device. In one non-limiting embodiment of the invention, at least two or more of the portions of the base member are pivotally connected together. In one non-limiting aspect of this embodiment of the invention, at least two portions of the base member are connected to a hinge, a flexible material, a spring, and/or the like.

In yet another and/or alternative non-limiting aspect of the invention, the securing device in accordance with the present invention, at least one pressure pad and/or at least one portion of the base member includes a carrying handle to facilitate in the transport of the securing device.

One non-limiting object of the present invention is the provision of a securing device that can maintain a receptacle in position during the stirring and/or mixing of the contents of the receptacle.

Another and/or alternative non-limiting object of the present invention is the provision of a securing device that can be releaseably secured to a receptacle so as to inhibit or prevent the receptacle from moving and/or at least partially rotating and/or lifting while the contents of the receptacle are stirred and/or mixed.

Still another and/or alternative non-limiting object of the present invention is the provision of a securing device that can be designed for use with a wide variety of shaped and/or sized receptacles.

Yet another and/or alternative non-limiting object of the present invention is the provision of a securing device that can securely grip a receptacle at and/or below the top rim of the receptacle so as to not interfere with the stirring and/or mixing of the contents in the receptacle.

Still yet another and/or alternative non-limiting object of the present invention is the provision of a securing device that can be designed such that the weight of a user on at least a portion of the securing device is used to at least partially cause the securing device to engage and/or grip the receptacle.

Another and/or alternative non-limiting object of the present invention is the provision of a securing device that enables a user to easily and conveniently use the securing device to inhibit or prevent the rotation and/or other movements of the receptacle during the stirring and/or mixing of the receptacle contents.

Still another and/or alternative non-limiting object of the present invention is the provision of a securing device that is lightweight, easy to grasp, easy to carry, and/or has a compact configuration for storage and/or transport.

Yet another and/or alternative non-limiting object of the present invention is the provision of a securing device that includes a base member designed to receive at least a bottom portion of the receptacle, at least one pressure pad designed to receive a user generated pressure to at least partially cause the securing device to secure to the receptacle, and a plurality of arm members designed to moveably engage the receptacle so at to engage with and disengage from the receptacle.

Still yet another and/or alternative non-limiting object of the present invention is the provision of a securing device that at least one arm member is pivotally connected or interconnected with the base member.

Another and/or alternative non-limiting object of the present invention is the provision of a securing device that includes a base member having first and second portions that are moveable with respect to one another.

Still another and/or alternative non-limiting object of the present invention is the provision of a securing device that includes at least one pressure pad having a gripping surface that improves the grip between the hand or foot of user that is applying pressure to the at least one pressure pad.

Yet another and/or alternative non-limiting object of the present invention is the provision of a securing device that includes at least one arm member having a gripping surface that improves the grip between the arm member and a portion of the receptacle.

Still yet another and/or alternative non-limiting object of the present invention is the provision of a securing device that includes at least one arm member having a removable gripping surface that improves the grip between the arm member and a portion of the receptacle.

Another and/or alternative non-limiting object of the present invention is the provision of a securing device that at least one arm member is pivotally connected to at least a portion of the base member.

Still another and/or alternative non-limiting object of the present invention is the provision of a securing device that the base member includes at least two portions that can be at least partially folded together to reduce the size of the secure device and thereby facilitate in the transport and/or storage of the securing device.

Yet another and/or alternative non-limiting object of the present invention is the provision of a securing device that at least one pressure pad and/or at least one portion of the base member includes a carrying handle to facilitate in the transport of the securing device.

These and other objects, features and advantages of the present invention will become apparent from the subsequent description taken in conjunction with the accompanying drawings.

BRIEF DESCRIPTION OF THE FIGURES

Reference may now be made to the drawings, which illustrate various non-limiting embodiments that the invention may take in physical form and in certain parts and arrangements of parts wherein.

DETAILED DISCUSSION OF EMBODIMENTS

Figure 1:
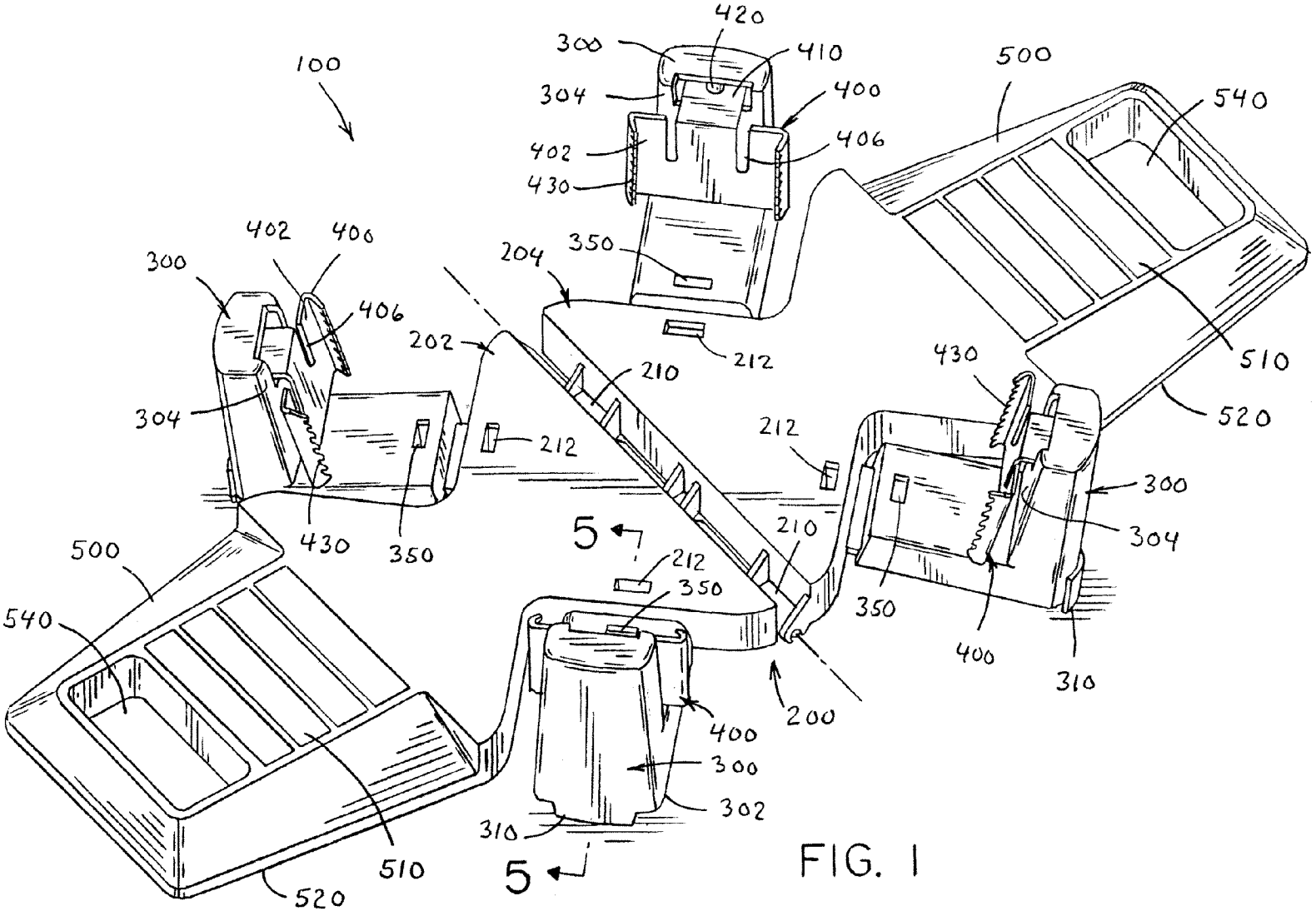
FIG. 1 is a perspective view of one non-limiting example of the securing device in accordance with the present invention.

Referring now to the drawings wherein the showing is for the purpose of illustrating preferred non-limiting embodiments of the invention only and not for the purpose of limiting the same, as illustrated in FIG. 1 there is provided a portable receptacle securing device configured to maintain a receptacle such as, but not limited to, a bucket (e.g., a conventional five gallon bucket, a pail, etc.) in a static position while the contents of the receptacle are stirred, mixed, etc. When the contents of a receptacle are stirred, mixed, etc., the contents in a receptacle have a tendency to transfer a movement force (e.g., rotational force, rocking force, lifting force, etc.) to the receptacle. Such movement force can cause the receptacle to move, the contents of the receptacle to splash out from the receptacle, etc. thereby interfering with the stirring and/or mixing of the receptacle contents and/or causing a mess during the stirring and/or mixing of the receptacle contents.

As illustrated in FIG. 1, the receptacle securing device 100 of the present invention is configured to counteract and/or stabilize the movement forces imparted on a receptacle 600 during the stirring, mixing, etc., the contents in a receptacle. As will be described in more detail below, the receptacle securing device of the present invention is designed to enable a user to easily and conveniently stabilize and/or affix in position a receptacle. The stabilization and/or affixation of the receptacle is accomplished in part by the weight of the receptacle and the design of the receptacle securing device. Accordingly, the receptacle securing device simplifies the processes for stirring, mixing, etc., the contents in a receptacle and further overcomes the negative aspects of spillage, wasted time, etc. that is commonly associated with the stirring, mixing, etc., the contents in a receptacle. The receptacle securing device 100 of the present invention can be suitably constructed from any appropriate materials and by any suitable techniques. For instance, the receptacle securing device can be constructed from plastic (e.g., polypropylene, etc.) that has been injection molded. Durable materials such as plastic are desirable since such materials are strong and rigid over a wide range of temperatures and conditions. In addition, plastic material will not dent or crush easily. Additionally, plastic is a lightweight, corrosion resistant material that can be formed in a variety of preselected colors and shapes. Furthermore, plastics can impart some degree of flexibility while still retaining a sufficient strength and durability profile. As can be appreciated, one or more portions of the receptacle securing device can be formed of other types of materials (e.g., metal, composite materials, wood, fiber reinforced materials, etc.).

Referring again to FIG. 1, the receptacle securing device 100 is designed to be a portable device. The receptacle securing device 100 is configured to be positioned on a ground-like surface such as, but not limited to, a floor, a grass-covered area, gravel surface, dirt surface, etc. As will be more fully described below, the receptacle securing device 100 in one non-limiting configuration is designed to utilize the weight of the receptacle 600 and pressure from a user's feet to at least partially stabilize and/or affix in position the receptacle.

The receptacle securing device 100 includes a base section 200 that is formed of first and second base portions 202, 204; however, it can be appreciated that the base section can include more than two base portions. The two base portions are hingeably connected together as will be described in more detail below. Each base portion includes two arm members 300. As can be appreciated, one or both of the base portions can include more than or less than two arm members. As can also be appreciated, the same or different numbers of arm members can be secured to each base portion. The base portions can have the same or different size and/or shape. The arm members can have the same or different size and/or shape. Each of the arm members are moveable with respect to the base portions. Each of the arm members includes a gripping member 400 that is designed to engage a side surface of receptacle 600 and to at least partially stabilize and/or affix in position the receptacle between the arm members. Connected to each base portion 202, 204 is a pressure pad 500. The pressure pads are designed to be stepped upon or otherwise depressed by a user so as to cause the arm members to move toward and/or into contact with the receptacle 600.

Figure 2:
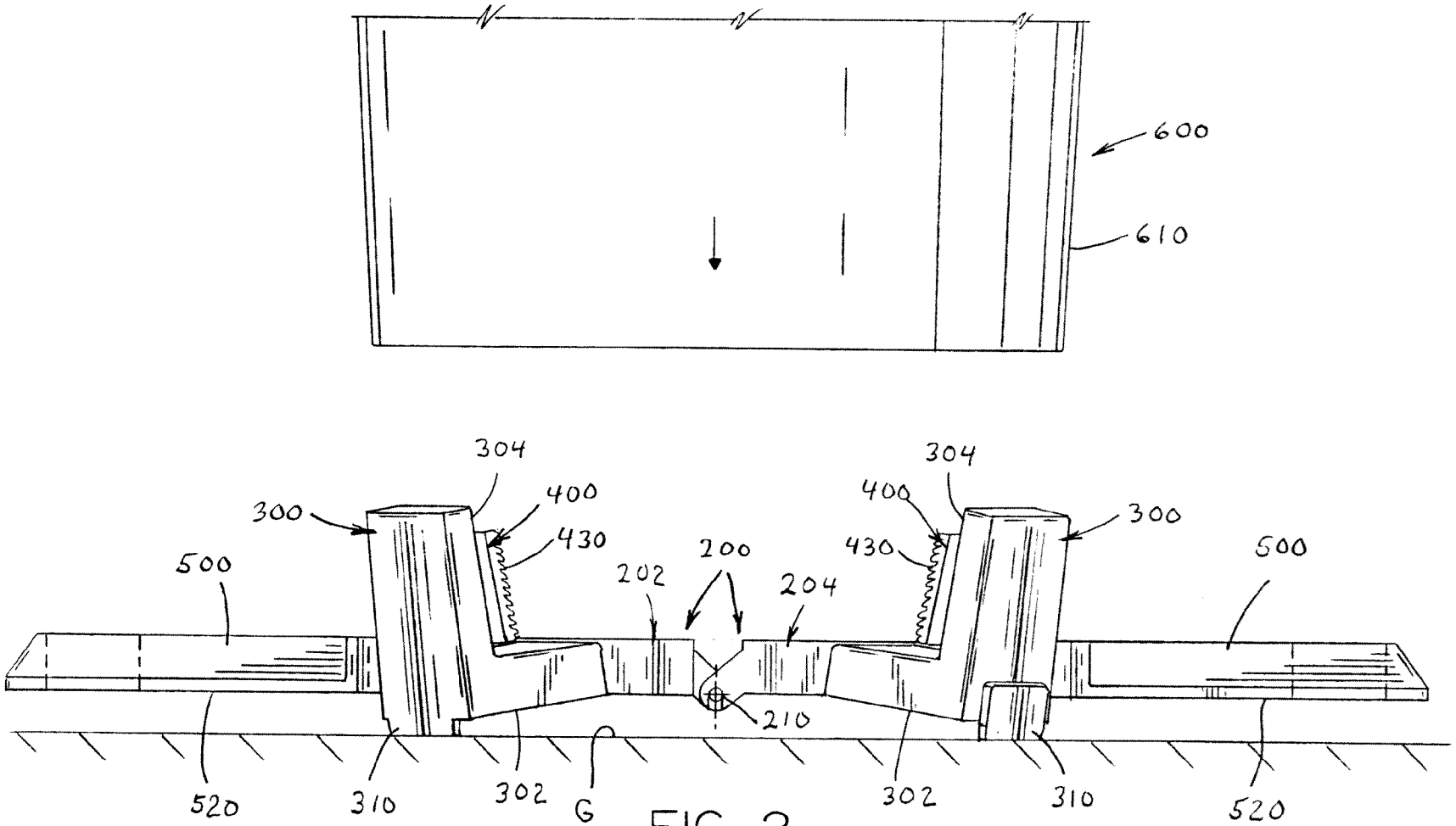
FIG. 2 is a side view of the securing device of FIG. 1 and illustrates a receptacle being inserted into the securing device.

As illustrated in 1, 2 and 4, the first and second base portions 202, 204 are connected together by one or more hinges 210 or other type of arrangement (e.g., live hinge, flexible connector, etc.) that enable the first and second base portions 202, 204 to be connected together and move relative to one another. As illustrated in FIG. 2, when the first and second base portions 202, 204 are in the open position and prior to a receptacle being placed on the base section and/or prior to a user depressing downwardly pressure pads 500, the hinge is elevated off of a ground surface G. As also illustrated in FIG. 2, the four arm members 300 are positioned in a slight tilt back position; however, this is not required. This tilt back position is designed to facilitate in the placement of the base of the receptacle 600 onto the first and second base portions 202, 204.

Figure 3:
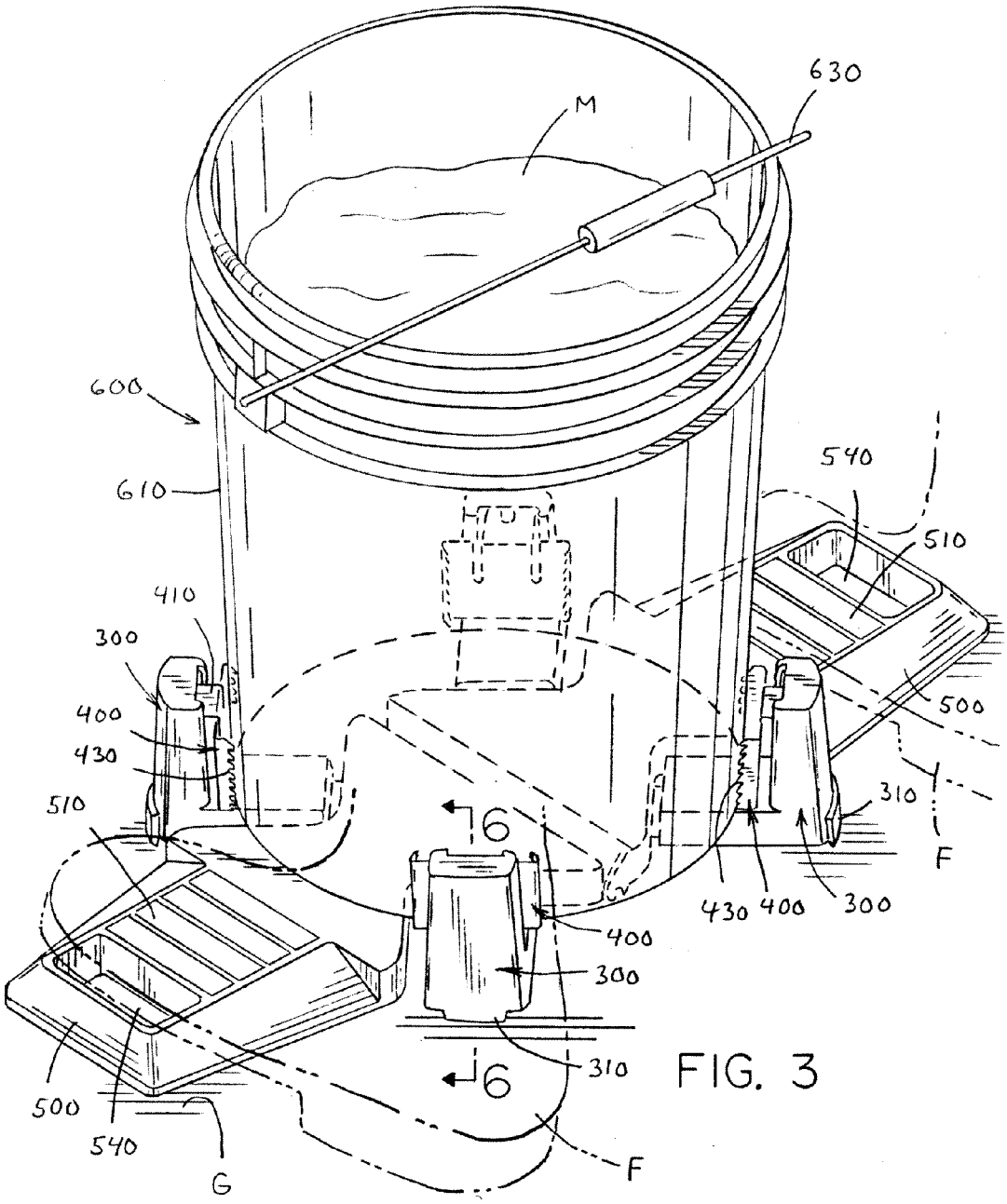
FIG. 3 is a perspective view of the securing device of FIG. 1 and illustrates a receptacle inserted into the securing device.
Figure 4:
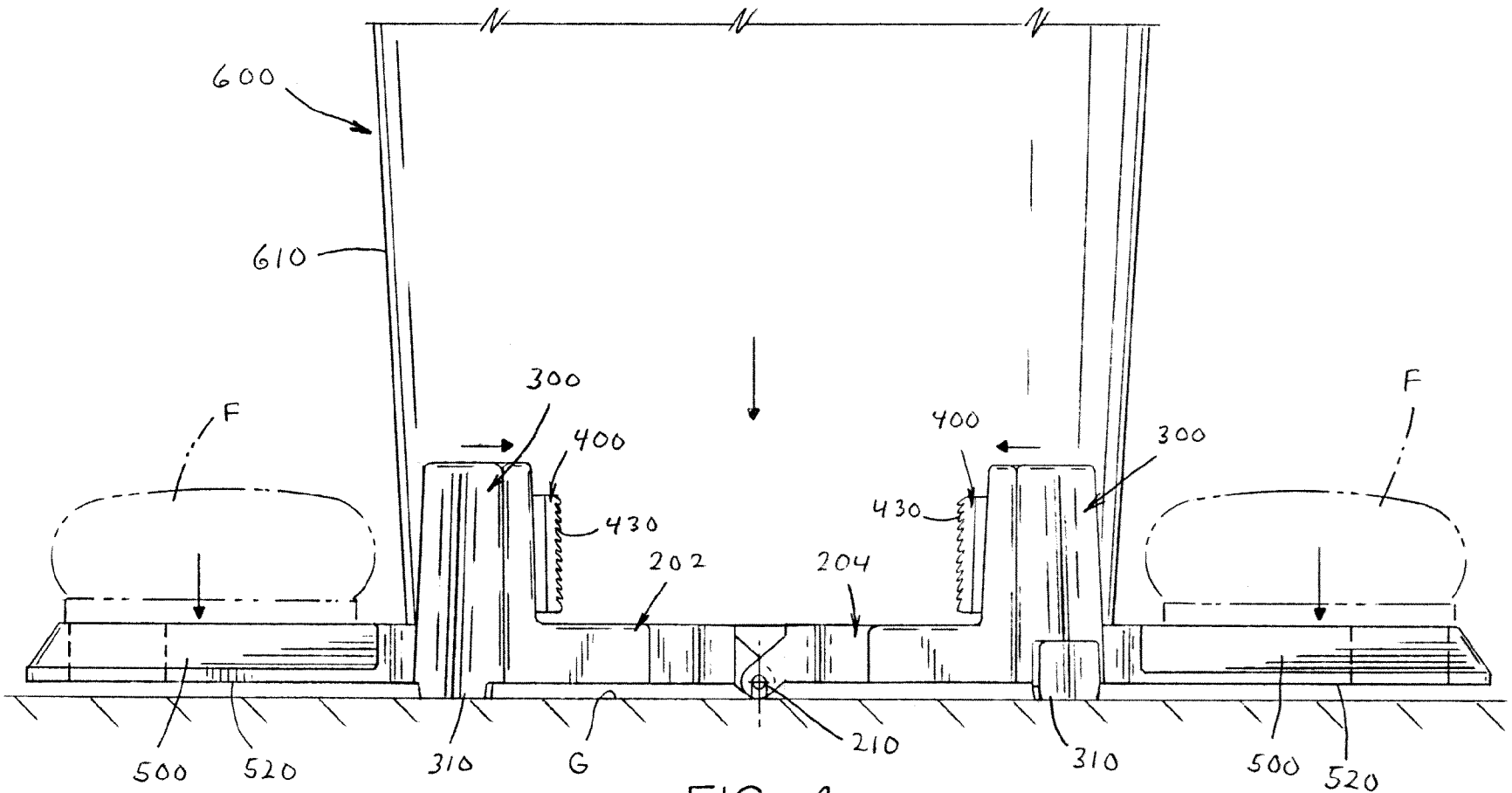
FIG. 4 is a side view of the securing device of FIG. 1 and illustrates the receptacle being secured in the securing device.
Figure 5:
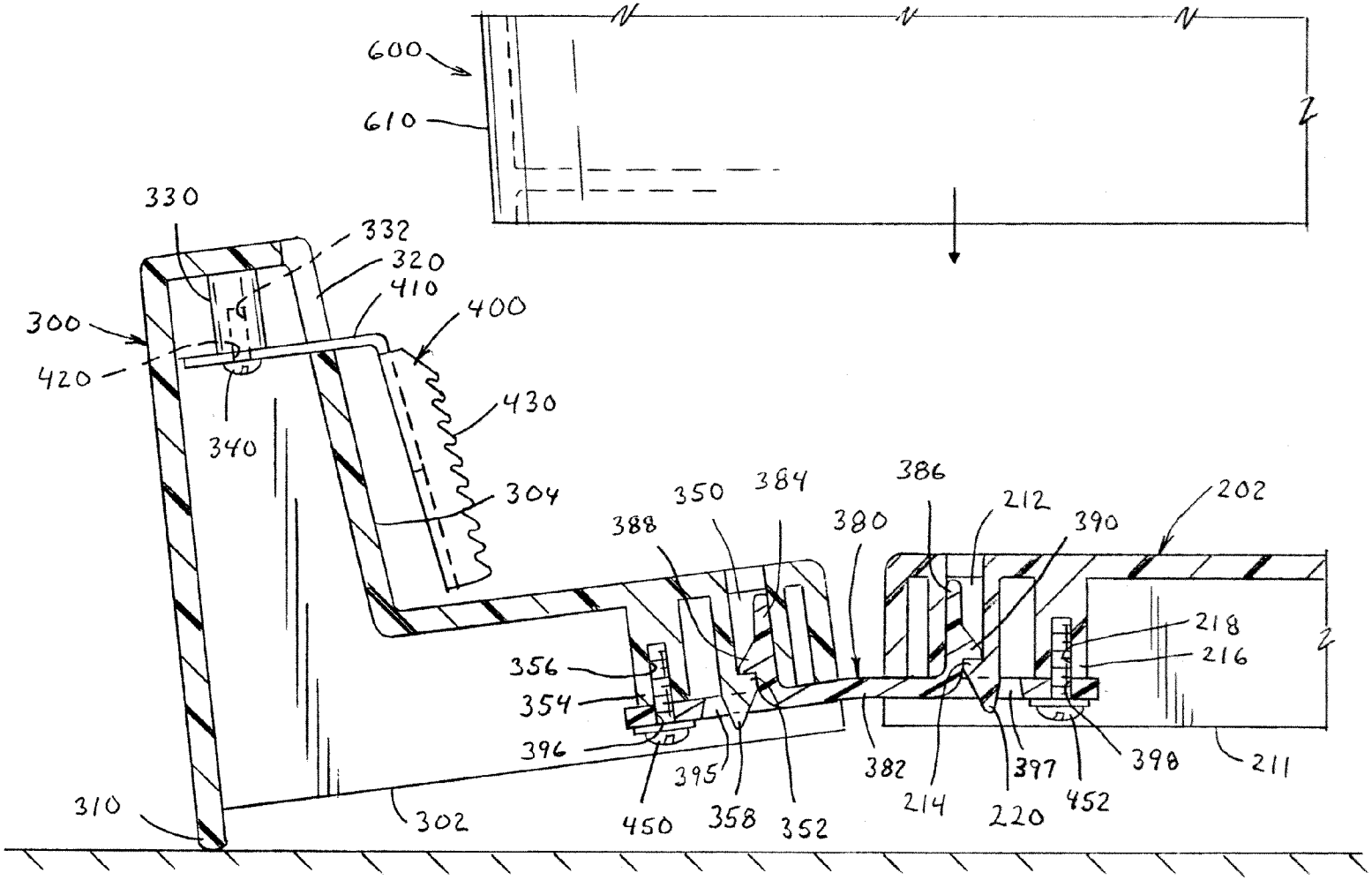
FIG. 5 is a cross-sectional view along lines 5-5 of FIG. 1.
Figure 8:
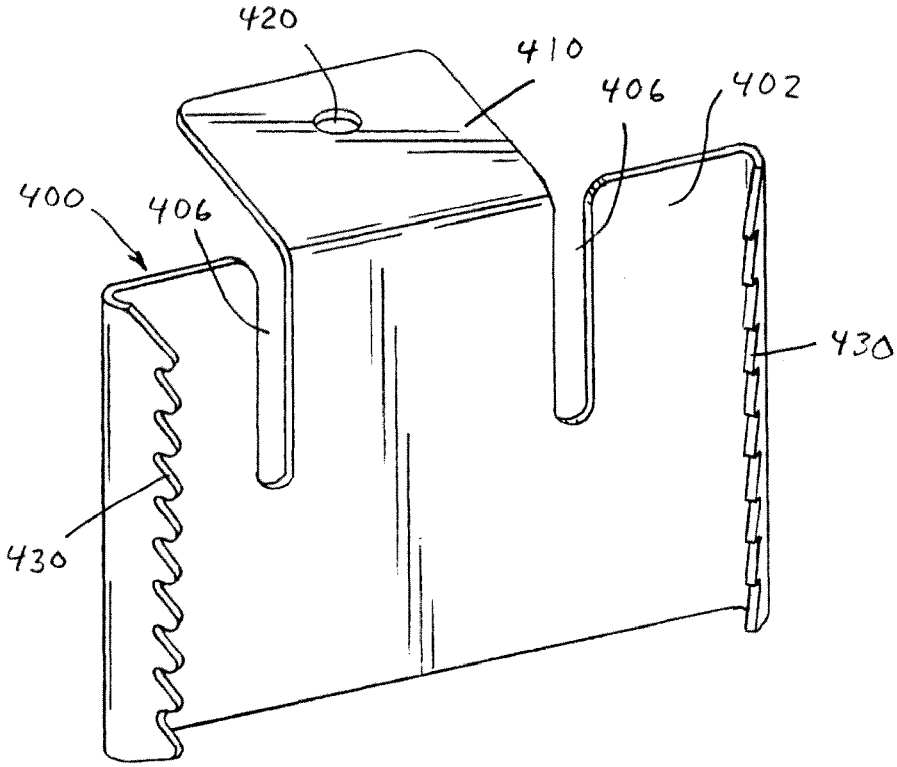
FIG. 8 is an elevation view of one non-limiting gripping surface member for the arm members in accordance with the present invention.

Referring now to FIGS. 1-6, each of the arm members 300 include a base extender 310 that is secured to the base 302 of the arm member. The base extender 310 is designed to facilitate in the elevation of the hinge 210 as illustrated in FIG. 2. The base extender 310 has a width that is small enough to enable the base of the arm member to pivot on the ground surface when receptacle 600 is placed on the base section and/or when a user depressing downwardly pressure pads 500. Referring now to FIG. 5, the front face 304 of each arm member 300 includes a connection slot 320 that is designed to receive a support flange 410 on gripping member 400. The interior of each arm member 300 includes a mount surface 330 than is designed to receive a connector 340 (e.g., screw, rivet, etc.) so that the support flange can be connected to the arm member. As illustrated in FIG. 5, a connector 340 in the form of a screw is inserted through an opening 420 in the support flange 410 and threaded into an opening 332 in the mount surface 330 so as to secure the gripping member 400 to the arm member 300. The gripping member is generally formed of a durable material such as metal or plastic; however, other or additional materials can be used. The gripping member is designed to be replaceable; however, this is not required. As illustrated in FIG. 8, the face 402 of the gripping member includes a downwardly facing rake surface 430; however, it can be appreciated that the rake surface does not have to be angled downwardly. When the rake surface is angled downwardly, the downward angle is between about 1-85°, and typically about 20-70°; however, other angles can be used. The rake surface can also be angled inwardly; however, this is not required. When the rake surface is angled inwardly as illustrated in FIG. 8, the angle between the face 402 and the rake surface is between about 1-85°, and typically about 20-70°; however, other angles can be used. The two rake surfaces on the gripping member can have the same or different angles relative to face 402. The rake surface is designed to facilitate in engaging the outer surface of the receptacle and securing the receptacle to the receptacle securing device when the arm members move into engagement with the receptacle. The rake surface can also facilitate in inhibiting or preventing the receptacle from lifting out of the receptacle securing device when the contents of the receptacle are mixed, stirred, etc. The gripping member can include back slots 406 to provide some flexibility to the gripping member when the two rake surfaces engage the side of the receptacle; however, such slots are not required. The gripping member has been described as a member having a rake surface; however, it will be appreciated that many other or additional types of gripping members can be used (e.g., rubber pad, corrugated surface, teeth surface, sticky surface, etc.).

Figure 6:
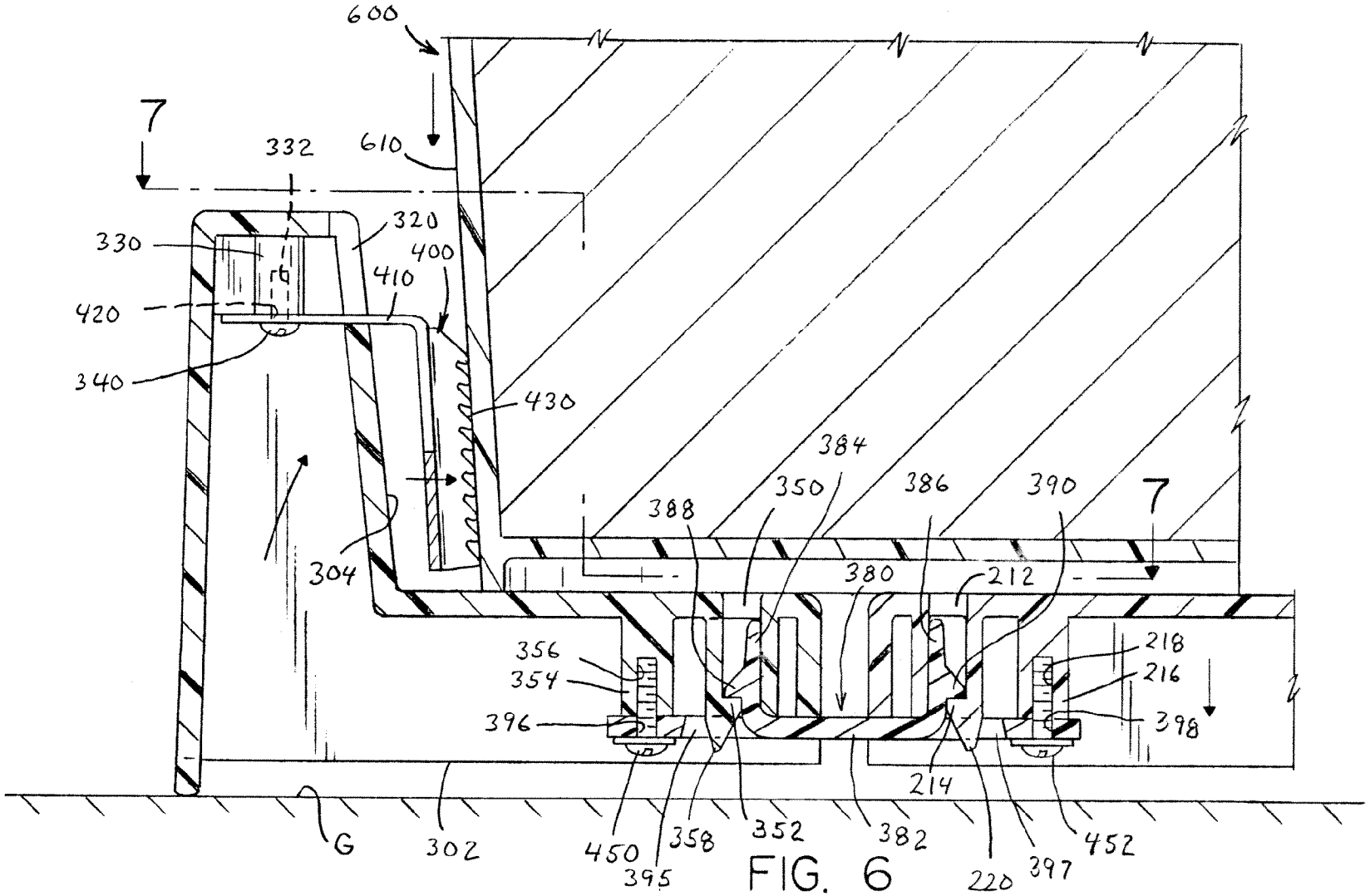
FIG. 6 is a cross-sectional view along lines 6-6 of FIG. 3.
Figure 7:
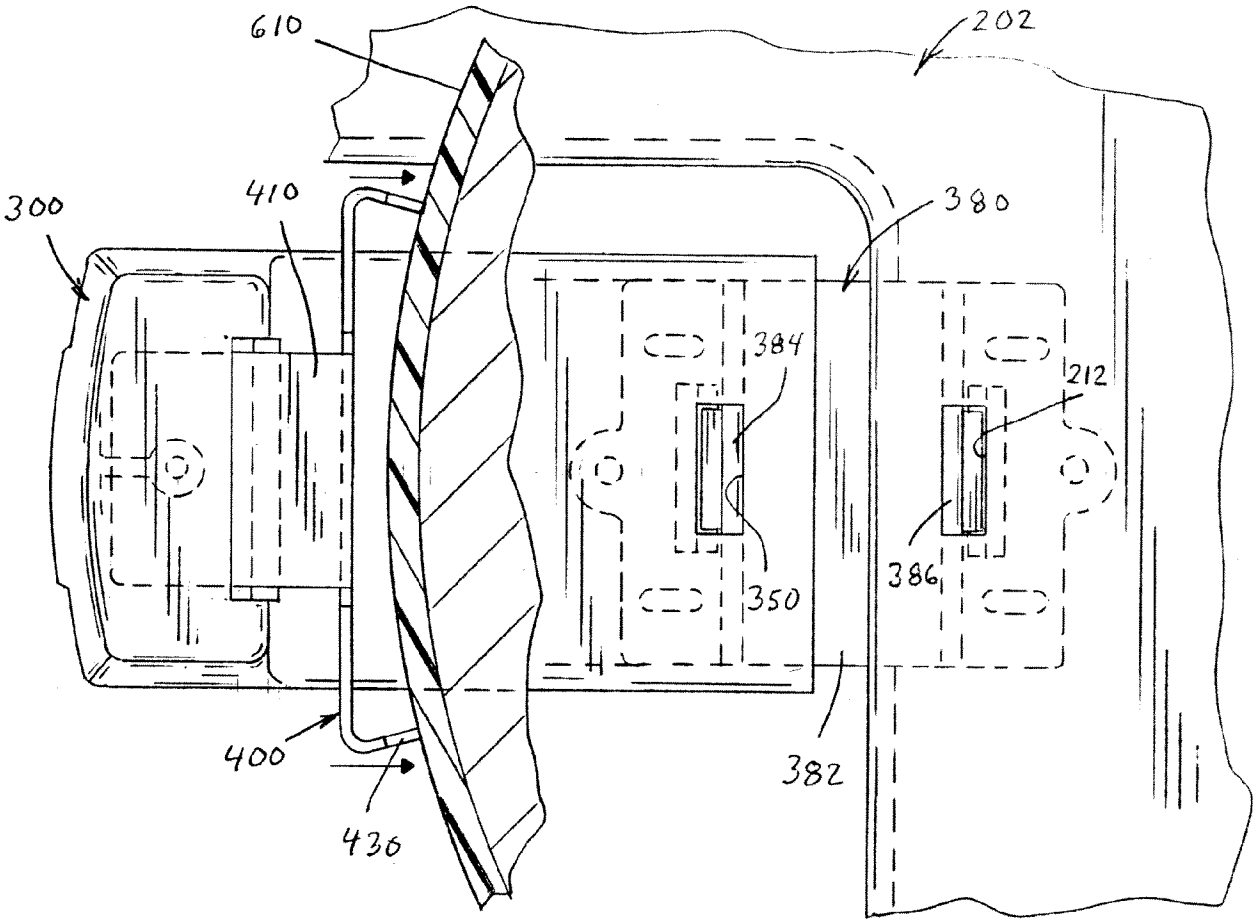
FIG. 7 is a cross-sectional view along lines 7-7 of FIG. 6.
Figure 9:
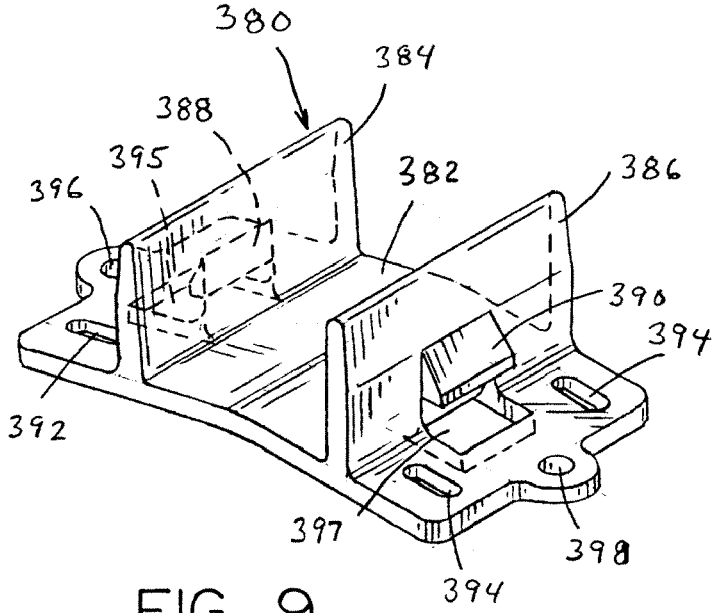
FIG. 9 is an elevation view of one non-limiting hinge member for the base member in accordance with the present invention; and, FIG. 10 illustrates the securing device in a folded configuration and being stored in the receptacle.

Referring now to FIGS. 5, 6 and 9, one or more of the arm members is pivotally or hingeably connected to a base portion by one or more live hinges or flexible connectors 380. The live hinge or connector is formed of a durable flexible material. Generally the material used is a low flex modulus material; however, this is not required. Many different types of materials can be used. Two non-limiting types of materials that can be used to at least partially form the live hinge or flexible connector are polypropylene or high density polyethylene. As illustrated in FIGS. 5 and 6, the base 302 of the arm member and base 211 of first and second base portions 202, 204 include structures that enable the live hinge or flexible connector 380 to be secured to the arm member and base portion. For example, base portion 202 includes a connection slot 212, a landing 214, a mount surface 216 having an opening 218, a connector tab 220 and two securement landings (not shown). Likewise, the base 302 of arm member 300 includes a connection slot 350, a landing 352, a mount surface 354 having an opening 356, a connector tab 358 and two securement landings (not shown). As can be appreciated, the base of the arm member and/or base portion can include other or additional structures that are used to facilitate in the connection of the live hinge or flexible connector 380 to the arm member and/or base portion. Referring now to FIG. 9, the live hinge or flexible connector 380 includes several structures that enable the live hinge or flexible connector to be secured to the arm member and base portion. For example, live hinge or flexible connector 380 includes a flexible bridge 382, two upwardly extending flanges 384, 386, a landing 388, 390 on each flange, a pair of slots 392, 394 on each end of the live hinge or flexible connector, and a connector opening 396, 398 on each end of the live hinge or flexible connector.

Referring to FIGS. 5 and 6, bridge 382 is designed to span between the base portion and arm member to form a flexible connection between the base portion and the arm member. The bridge also forms a space between the arm member and the base portion to enable the arm member and base portion to move some distance relative to one another. The live hinge or flexible connector 380 is connected to the arm member by inserting flange 384 into slot 350 until landing 388 rests on landing 352 thereby forming a mechanical connection between the live hinge or flexible connector and the arm member. Connector tab 358 is inserted though opening 395 to facilitate in securing the live hinge or flexible connector and the arm member. A screw or other type of connector 450 is inserted through opening 396 and secured in opening 356 of mount surface 354 to also facilitate in securing the live hinge or flexible connector and the arm member; however, this is not required. The two slots 392 can be inserted onto securement landings on the base of the arm member to further facilitate in securing the live hinge or flexible connector and the arm member; however, this is not required. The connection via opening 396 and/or the connection between slots 392 and the securement landings, when used, are generally used to inhibit or prevent shear forces on the live hinge or flexible connector. The live hinge or flexible connector 380 is connected in a similar manner to the base portion. The flange 386 is inserted into slot 212 until landing 390 rests on landing 214 thereby forming a mechanical connection between the live hinge or flexible connector and the base portion. Connector tab 220 is inserted though opening 397 to facilitate in securing the live hinge or flexible connector and the base portion. A screw or other type of connector 452 is inserted through opening 398 and secured in opening 218 of mount surface 216 to also facilitate in securing the live hinge or flexible connector and the base portion; however, this is not required. The two slots 394 can be inserted onto securement landings on the base of the base portion to further facilitate in securing the live hinge or flexible connector and the base portion; however, this is not required. The connection via opening 398 and/or the connection between slots 394 and the securement landings, when used, are generally used to inhibit or prevent shear forces on the live hinge or flexible connector.

The live hinge or flexible connector 380 is shaped in a certain manner and/or mounted to the arm member and the base portion in a certain manner so as to cause the arm member to slightly cause the base portion to be elevated off of a ground surface when a receptacle is not positioned on the base section and/or downward pressure is not being applied to pressure pads 500. This elevated position of the base portions 202, 204 from the ground surface is illustrated in FIGS. 2 and 5. As shown in FIG. 5, base 302 of the arm member can be angularly orientated relative to the base 211 of the base portion; however, this is not required. When the plane of base 302 is different from the plane of base 211, the two planes generally offset by an angle of about 1-60°, and generally about 1-30°; however, other offset angles can be used. The orientation of base 211 of the base portions is illustrated as being generally parallel to the ground surface; however, this is not required.

Referring again to FIG. 1, the pressure pads 500 that are connected to base portions 202, 204 include a gripping surface 510. This gripping surface is generally a non-smooth surface. Many types of gripping surfaces can be used in accordance with the present invention (e.g., ribs, slots, teeth, corrugated surface, etc.). Grip materials and/or coatings (rubber coating, rubber pad, etc.) can also or alternatively be applied to the pressure pads to form a gripping surface. The pressure pads are illustrated as having a generally uniform thickness; however, this is not required. For instance, the pressure pads can include one or more tapered surfaces; however, this is not required. The orientation of the base 520 of the pressure pads is illustrated in FIG. 2 as being generally parallel to the ground surface; however, this is not required. The base of one or more of the pressure pads can include one or more grip and/or friction surfaces and/or structures (e.g., raised formations, projecting tine-like barbs, serrated projections, rubber pads, etc.) that are used to increase the friction between the one or more pressure pads and the ground surface; however, this is not required. The ends of the pressure pads can include an opening 540; however, this is not required. The openings can be used as handles to facilitate in folding the receptacle securing device 100 in a stored or compact arrangement and/or to carry the receptacle securing device.

Figure 10:
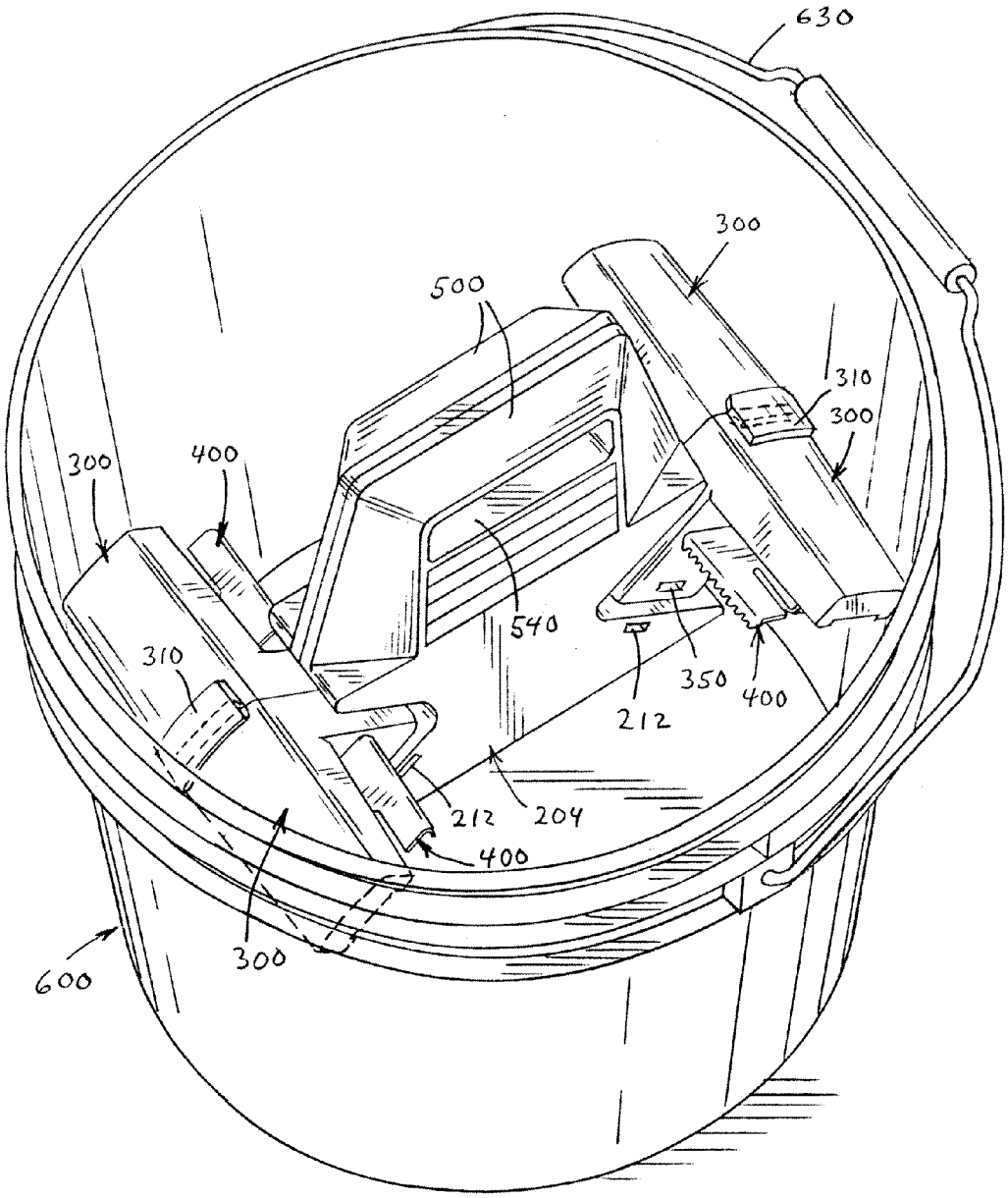

The operation of the receptacle securing device 100 will now be briefly described. The receptacle securing device 100 as illustrated in FIGS. 1, 3 and 4 includes four arm members 300 that are designed to be forwardly biased onto and grippingly engage an exterior surface 610 of receptacle 600. The biasing of the arm members toward the receptacle applies a frictional pressure on the outer surface of the receptacle that is designed to reduce or overcome the rotational tendencies of the receptacle that can be cause by the stirring and/or mixing of the contents of the receptacle. The pressure pads 500 on the receptacle securing device 100 are designed to receive pressure from a user and to transfer such pressure to the arm members to thereby cause the arm members to increase the grip on the receptacle. The pressure pads can receive pressure from the user in the form of the user placing the user's feet on the pressure pads such as by standing on the pressure pads. Alternatively and/or additionally, the pressure pads can receive pressure from the user in the form of the user placing the user's knees and/or hands on the pressure pads. When a user stands of the pressure pads or positions his/her knees on the pressure pads, the user can then use his/her hands to stir/mix the contents of the receptacle by hand and/or by use of some other device while simultaneously securing the receptacle in position during the stirring and/or mixing operation. As mentioned above, the receptacle securing device can be designed to be used with many different types and/or shapes of receptacles (bucket, pail, cans, containers, etc.). As illustrated in FIGS. 3 and 10, receptacle 600 is a standard five (5) gallon container that can be used to hold a number of different materials. The container includes a standard handle 630 that is used to lift and transport the container. For purposes of the describing the operation of the receptacle secure device, the five (5) gallon container will be referred to; however, as stated above, the receptacle securing device can be designed for use with many other types of receptacle, thus its use is not limited to standard five (5) gallon containers. The four arm members are designed to cooperate in applying a grip-like engaging force on the exterior surface 610 of the receptacle 610. The arm members are positioned on the base section such that two arm members are directly opposite each other; however, this is not required. This arm member orientation for a four arm member arrangement can be used to increase the strength of the grip applied by the arm members to the receptacle.

FIGS. 1 and 2 illustrate the receptacle securing device prior to the receptacle being inserted into the receptacle securing device. As illustrated in FIG. 2, the arm members can be designed and mounted to the base portions so as to tilt slight outwardly form the center of the receptacle securing device; however, this is not required. The base of the receptacle is positioned above the center of the base section 200 and then lowered onto the base section as illustrated by the arrow in FIG. 2. The tilting orientation of the arm members can be used to facilitate in the insertion of the base of the receptacle onto the base section 200 of the receptacle securing device. Once the receptacle 600 is inserted onto the base section as illustrated in FIG. 3, the weight of the receptacle causes the base portions to move downwardly toward the ground surface G. The movement of the base portions toward the ground cause the arm members to pivot toward the center of the receptacle securing device and thereby cause the gripping member 400 on the arm members to engage and/or increase the gripping force between the gripping members and the side of the receptacle. When the receptacle is a heavy container and/or includes a material M, the weight of the receptacle naturally causes the gripping members on the arm members to tightly engage the side of the receptacle and inhibit or prevent movement of the receptacle during the mixing or stirring of material M in the receptacle. The gripping force on the receptacle can be further increased by the user placing his/her feet F on the pressure pads 500 as illustrated in FIGS. 3 and 4. The downward pressure applied by the user's feet causes the pressure pads to move toward the ground surface G if the pressure pads are not already in contact with the ground surface. As illustrated in FIG. 4, hinge 210 is designed to limit the downward movement of the base portions to the ground; however, this is not required. As also illustrated in FIG. 4, hinge 210 is designed to contact a level ground surface G prior to the base 520 of the pressure pads 500 contacting the ground surface; however, this is not required. As represented by the arrows in FIG. 4, the downward pressure applied by the two feet of the user causes the base portions to also move toward the ground surface. In addition, the weight of the receptacle also causes the base portions to move toward the ground surface. The movement of the base portions toward the ground surface causes the four arm members 300 to pivot toward the center of the receptacle securing device and thereby cause the gripping member 400 to frictionally engage the side 610 of the receptacle. The frictional engagement of the gripping members with the side of the receptacle inhibits or prevents the movement of the receptacle in the receptacle securing device, thus enabling a user to stir or mix material M in the receptacle with little or no concern that the receptacle will rotate and/or lift out from the receptacle securing device during the mixing or stirring operation. The receptacle securing device of the present invention enables a user to stand or kneel on the pressure pads that simultaneously performs the desired mixing or stirring operation of the materials in the receptacle while the receptacle is constantly stabilized during such mixing and/or stirring operations.

Once the material M has been stirred, mixed or otherwise processed in the desired manner, the user removes his/her feet from the pressure pads 500, which causes a lessening of the frictional pressure being applied by the arm members on the side of the receptacle. The remaining frictional pressure being applied by the arm members on the receptacle can be easily reduced, eliminated or overcome by the user grasping handle 630 and lifting the receptacle off of the base section 200. The operation above can then be repeated for further mixing or stirring operations using the same or different receptacle.

The hinge 210 on the receptacle securing device can be designed to enable the receptacle securing device to be folded into a storage and/or transport position. As illustrated in FIG. 10, the receptacle securing device 100 can be folded in half and conveniently be inserted onto receptacle 600 for later use. Alternatively, the receptacle securing device 100 can be folded in half and conveniently be carried by a user by the user grasping the ends of the pressure pads via openings 540. The receptacle securing device 100 can be maintained or secured in the storage position use of a connector (e.g., latch, lock, Velcro, etc.) and/or by a friction engagement. As illustrated in FIG. 10, two of the base extenders 310 on the arm members can be modified to frictionally engage an adjacent arm member when the receptacle securing device is folded into the storage position. In storage position, the base of the base portions 202, 204 and the arm members 300 are in generally continuous contact or are positioned in a closely spaced apart relationship. The storage position of the receptacle securing device reduces the size profile of the receptacle securing and facilitates its storage and transport. In one desired, but non-limiting arrangement, the receptacle securing device is suitably constructed of a size that permits it to be stored in a folded state in the receptacle. The reduced size profile of the receptacle securing device also facilitates commercial considerations such as less space is required for shipping and less space is required for shelf display in a retail store.

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall therebetween. The invention has been described with reference to the preferred embodiments. These and other modifications of the preferred embodiments as well as other embodiments of the invention will be obvious from the disclosure herein, whereby the foregoing descriptive matter is to be interpreted merely as illustrative of the invention and not as a limitation. It is intended to include all such modifications and alterations insofar as they come within the scope of the appended claims.

I claim:

1. A receptacle securing device designed to releasably secure a receptacle in a generally static position during manipulation of contents in the receptacle comprising:

a base section for receiving a bottom of a receptacle, said base section including first and second base portions, said first and second base portions including front and back ends, said front ends of said first and second portions connected together;

two arm members pivotly connected to each of said first and second base portions, each of said arm members are spaced apart from one another, each of said arm members having a gripping surface on a front portion of said arm member, said gripping surface designed to engage a side of the receptacle when said arm member pivots toward the receptacle; and, a pressure pad connected to each second end of said first and second base portions, said pressure pads designed to receive user generated pressure which causes said arm members to pivot relative to said first and second base portions and thereby resulting in said gripping surfaces engaging a side of the receptacle to inhibit or prevent movement of the receptacle relative to said arm members, said arm members causing both of said pressure pads to be completely elevated above a floor surface when a base of each of said arm members is positioned on the floor surface below a bottom surface of said base section and prior to a user generating pressure on said pressure pads.

2. The receptacle securing device as defined in claim 1, wherein said first and second base portions are hingeably connected together to enable said front ends of said first and second portions to move downwardly as said arm members pivot relative to said first and second base portions and engage the side of the receptacle, said first and second base portions are hingeably connected together so that said first and second base portions can be folded together in a compact storage position such that a bottom surface of said first and second base portions face one another in said compact storage position.

3. The receptacle securing device as defined in claim 2, wherein said first and second base portions include a top surface designed to support a bottom portion of the receptacle while said gripping surface on each of said arm members engage the side of the receptacle, said gripping surfaces extending above said top surface while the bottom portion of the receptacle is positioned on said top surface of said first and second base portions.

4. The receptacle securing device as defined in claim 1, wherein said base of said arm members extends below a bottom surface of said first and second base portions while said first and second base portions are oriented to receive the receptacle, said base of said arm members causing at least said front ends of said first and second base portions to be spaced above the floor surface while said base of said arm members is resting on the floor surface and prior to a user generating pressure on said pressure pads and prior to the receptacle being placed on said first and second base portions.

5. The receptacle securing device as defined in claim 3, wherein said base of said arm members extends below said bottom surface of said first and second base portions while said first and second base portions are oriented to receive the receptacle, said base of said arm members causing at least said front ends of said first and second base portions to be spaced above the floor surface while said base of said arm members is resting on the floor surface and prior to a user generating pressure on said pressure pads and prior to the receptacle being placed on said first and second base portions.

6. The receptacle securing device as defined in claim 1, wherein said arm members on each of said first and second base portions include a base extender that extends downwardly and below a bottom surface of said arm members, said base extender designed to elevate said bottom surface of said arm members above the floor surface and prior to a user generating pressure on said pressure pads and prior to the receptacle being placed on said first and second base portions.

7. The receptacle securing device as defined in claim 5, wherein said arm members on each of said first and second base portions include a base extender that extends downwardly and below a bottom surface of said arm members, said base extender designed to elevate said bottom surface of said arm members above the floor surface and prior to a user generating pressure on said pressure pads and prior to the receptacle being placed on said first and second base portions.

8. The receptacle securing device as defined in claim 2, wherein said first and second base portions connect together to form an hour-glass shape.

9. The receptacle securing device as defined in claim 7, wherein said first and second base portions are connect together to form an hour-glass shape.

10. The receptacle securing device as defined in claim 1, wherein said arm members include a bottom and top arm portion, said bottom portion pivotly connected to one of said base portions and extending outwardly from said base portion while said first and second base portions are oriented to receive the receptacle, said top arm portion connected to said bottom arm portion and extending upwardly from said bottom arm portion.

11. The receptacle securing device as defined in claim 9, wherein said arm members include a bottom and top arm portion, said bottom portion pivotly connected to one of said base portions and extending outwardly from said base portion while said first and second base portions are oriented to receive the receptacle, said top arm portion connected to said bottom arm portion and extending upwardly from said bottom arm portion.

12. The receptacle securing device as defined in claim 1, wherein said pressure pad includes a gripping portion and a handle opening, said gripping portion designed to receive said user generated pressure and to inhibit or prevent slippage by said user on said pressure pad, said handle opening designed to function as a carrying handle to enable the user to place fingers through said handle opening to facilitate in transporting said receptacle securing device.

13. The receptacle securing device as defined in claim 11, wherein said pressure pad includes a gripping portion and a handle opening, said gripping portion designed to receive said user generated pressure and to inhibit or prevent slippage by said user on said pressure pad, said handle opening designed to function as a carrying handle to enable the user to place fingers through said handle opening to facilitate in transporting said receptacle securing device.

14. A receptacle securing device designed to releasably secure a receptacle in a generally static position during manipulation of contents in the receptacle comprising:

a base section for receiving a bottom of a receptacle, said base section including first and second base portions, said first and second base portions including front and back ends, said first and second base portions include a top surface designed to support a bottom portion of the receptacle; two arm members pivotly connected to each of said first and second base portions, each of said arm members are spaced apart from one another, each of said arm members having a gripping surface on a front portion of said arm member, said arm members including bottom and top arm portions, said bottom portion pivotly connected to one of said base portions and extending outwardly from said base portion, said top arm portion connected to said bottom arm portion and extending upwardly from said bottom arm portion, said gripping surfaces extending above said top surface of said first and second base portions while the bottom portion of the receptacle is positioned on said top surface of said first and second base portions, said gripping surface designed to engage a side of the receptacle when said arm member pivots toward the receptacle; and, said front portions of said first and second base portions are hingeably connected together to enable said front ends of said first and second portions to move downwardly as said arm members pivot relative to said first and second base portions and engage the side of the receptacle, said first and second base portions are hingeably connected together so that said first and second base portions can be folded together in a compact storage position such that a bottom surface of said first and second base portions face one another in said compact storage position; and, a pressure pad connected to each second end of said first and second base portions, said pressure pads designed to receive user generated pressure which causes said arm members to pivot relative to said first and second base portions and thereby resulting in said gripping surfaces engaging a side of the receptacle to inhibit or prevent movement of the receptacle relative to said arm members, said arm members causing both of said pressure pads to be completely elevated above a floor surface when a base of each of said arm members is positioned on the floor surface below a bottom surface of said base section and prior to a user generating pressure on said pressure pads.

15. The receptacle securing device as defined in claim 14, wherein a base of said arm members extends below a bottom surface of said first and second base portions while said first and second base portions are oriented to receive the receptacle, said base of said arm members causing at least said front ends of said first and second base portions to be spaced above the floor surface while said base of said arm members is resting on the floor surface and prior to a user generating pressure on said pressure pads and prior to the receptacle being placed on said first and second base portions.

16. The receptacle securing device as defined in claim 14, wherein said arm members on each of said first and second base portions include a base extender that extends downwardly and below a bottom surface of said arm members, said base extender designed to elevate said bottom surface of said arm members above the floor surface and prior to a user generating pressure on said pressure pads and prior to the receptacle being placed on said first and second base portions.

17. The receptacle securing device as defined in claim 15, wherein said arm members on each of said first and second base portions include a base extender that extends downwardly and below a bottom surface of said arm members, said base extender designed to elevate said bottom surface of said arm members above the floor surface and prior to a user generating pressure on said pressure pads and prior to the receptacle being placed on said first and second base portions.

18. The receptacle securing device as defined in claim 14, wherein said first and second base portions connect together to form an hour-glass shape.

19. The receptacle securing device as defined in claim 17, wherein said first and second base portions connect together to form an hour-glass shape.

20. The receptacle securing device as defined in claim 14, wherein said pressure pad includes a gripping portion and a handle opening, said gripping portion designed to receive said user generated pressure and to inhibit or prevent slippage by said user on said pressure pad, said handle opening designed to function as a carrying handle to enable the user to place fingers through said handle opening to facilitate in transporting said receptacle securing device.

21. The receptacle securing device as defined in claim 19, wherein said pressure pad includes a gripping portion and a handle opening, said gripping portion designed to receive said user generated pressure and to inhibit or prevent slippage by said user on said pressure pad, said handle opening designed to function as a carrying handle to enable the user to place fingers through said handle opening to facilitate in transporting said receptacle securing device.

22. The receptacle securing device as defined in claim 21, wherein said gripping surface is detachably connected to said arm member.

23. The receptacle securing device as defined in claim 21, wherein at least one of said gripping surfaces include a pair of spaced apart longitudinally extending engagement flanges.

24. The receptacle securing device as defined in claim 21, wherein said first and second base portions include a total of four of said arm members.

* * * * *